United States Patent [19]

Gunter et al.

[11] Patent Number: 4,775,346

[45] Date of Patent: Oct. 4, 1988

[54] APPARATUS FOR ANCHORING A FLOTATION DEVICE

[76] Inventors: Terry L. Gunter, Rte. 4, Box 377, Bowie, Tex. 76230; Cheryl A. Meliones, 232 Whispering Hills Dr., Coppell, Tex. 75019

[21] Appl. No.: 905,250

[22] Filed: Sep. 8, 1986

[51] Int. Cl.[4] ..... B63C 9/08

[52] U.S. Cl. ..... 441/129; 441/23; 114/293; 114/296

[58] Field of Search ..... 114/293, 294, 296, 351; 441/23, 129, 130, 131, 132; D21/236, 237; 272/1 B, 32, 272

[56] References Cited

U.S. PATENT DOCUMENTS

| | | | |
|---|---|---|---|
| 2,850,252 | 9/1958 | Ford | 441/129 |
| 2,938,727 | 5/1960 | Nosak | 272/1 B |
| 3,014,723 | 12/1961 | Butler | 272/1 B |
| 3,858,877 | 1/1975 | Lundstrom | 114/267 |
| 3,895,801 | 7/1975 | Baird | 272/1 B |
| 3,988,020 | 10/1976 | Carter | 272/71 |
| 4,519,783 | 5/1985 | Burke | 114/296 |

OTHER PUBLICATIONS

"Velcro" ad from "The Ships Store", catalog, 1981, p. 61.

*Primary Examiner*—Joseph F. Peters, Jr.
*Assistant Examiner*—Thomas J. Brahan
*Attorney, Agent, or Firm*—W. Kirk McCord

[57] ABSTRACT

An apparatus for anchoring a flotation device is comprised of a plurality of adjustable straps attached at respective first ends thereof to a lower major surface of a flotation device which is in contact with the water. A suction device is attached at a second end of each strap opposite from the first end thereof, for securing the corresponding strap to a stationary object, such as the side of a swimming pool. By attaching selected ones of the straps to a stationary object and adjusting the respective lengths of the selected straps, the flotation device can be anchored in a substantially fixed position and desired orientation with respect to the statonary object. Thus, a sunbather can position the flotation device as desired with respect to the location of the sun to take full advantage thereof. The anchoring apparatus according to the present invention is suitable for attachment to flotation devices of various types and materials.

20 Claims, 2 Drawing Sheets

APPARATUS FOR ANCHORING A FLOTATION DEVICE

FIELD OF THE INVENTION

The present invention relates to flotation devices and in particular to an apparatus for anchoring a flotation device to a stationary object.

BACKGROUND OF THE INVENTION

Flotation devices, such as rubber rafts, inflatable air mattresses and the like, are frequently used for recreational activities in the water. Such devices are typically comprised of individual airtight compartments for receiving pressure air to inflate the device to the desired buoyancy so as to be able to support the weight of an adult and still remain afloat. Other devices such as float chairs, may have one or more lighter-than-air flotation members manufactured out of such materials as expanded polystyrene (commonly known under the registered trademark Styrofoam).

Many people find it relaxing to recline on such flotation devices in the middle of a pool or small lake. Flotation devices, such as inflatable air mattresses or float chairs, are often used by sunbathers.

One problem associated with the use of such mattresses or float chairs in a swimming pool is that they will often drift into an area where there is unwanted commotion, such as diving or general "horseplay", which could result in the mattress or chair being tipped over or at least in the disruption of the tranquility that one experiences when using the flotation device. Another problem associated with such flotation devices is that it is difficult to properly align the device to take advantage of the sun's position when one is engaged in sunbathing because the device tends to drift randomly in the water.

DESCRIPTION OF THE PRIOR ART

Apparatus for anchoring various types of flotation devices are known in the art. One such apparatus is shown in U.S. Pat. No. 2,850,252, which teaches an inflatable mat structure anchored to the ground by means of a plurality of elongated spikes. The anchoring apparatus shown in this patent would not be suitable for use in the water or to anchor an inflatable air mattress to the side of a swimming pool or the like.

It is also known in the art to use suction cups and the like to adhere to the smooth surface of a solid object. Such suction devices are shown in U.S. Pat. Nos. 556,816; 2,145,142; 3,976,274; and 4,328,761. Furthermore, certain types of suction devices can be used underwater, as described in U.S. Pat. Nos. 3,976,274 and 4,328,761. There is, however, no teaching or suggestion in the prior art as to how a flotation device can be anchored to a relatively flat surface such as the side of a swimming pool or as to how the flotation device can be positioned as desired relative to the side of a swimming pool or other stationary object.

A need therefore exists in the art for an apparatus which is both economical and easy to use for anchoring a flotation device in a predetermined, fixed position in the water with respect to a stationary object such as the side of a swimming pool or a dock.

SUMMARY OF THE INVENTION

The present invention provides an apparatus for anchoring a flotation device to a stationary object when the device is floating in a body of water. The flotation device has sufficient buoyancy and surface area above the water line for supporting the weight of the user so that the user's body is maintained substantially completely above the water line. The apparatus is comprised of a plurality of strap members, means for selectively adjusting the respective lengths of the strap members, means for attaching respective first ends of the strap members to the flotation device at respective predetermined positions on a surface thereof and suction means coupled to each of the strap members adjacent to a second end of each of the strap members opposite from the first end for attaching the respective strap members to a relatively flat vertical wall on a stationary object above the water line to anchor the flotation device to the stationary object. The position and orientation of the flotation device relative to the stationary object is selectively determined by the predetermined positions on the flotation device at which the strap members are attached and by the adjustment of the respective lengths of the strap members.

In one embodiment the apparatus includes a plurality of strap members attached at respective predetermined positions on the flotation device, for preventing the device from twisting with respect to the stationary object when the strap members are anchored to the stationary object.

In another embodiment the suction means is comprised of a suction device having a cup-shaped member for providing a suction attachment to the stationary object, such as the side of a swimming pool. A cylindrical nipple member is disposed in the approximate geometric center of the cup-shaped member and includes an opening extending radially therethrough for receiving a tie member or the like to attach the suction device to the corresponding strap member.

In another embodiment the means for attaching the strap members to the flotation device is comprised of a first attachment member having a first attachment surface for being secured to the lower major surface of the flotation device and a second attachment surface opposite from the first attachment surface, and a second attachment member having a third attachment surface which is in contact with the first end of the corresponding strap member and a fourth attachment surface opposite from the third attachment surface which is complementary with the second attachment surface. When the fourth attachment surface is pressed into contact with the second attachment surface, the first and second attachment members are securely fastened together to attach the strap member to the flotation device.

In the preferred embodiment the flotation device is comprised of a relatively flat rectangular inflatable member having a substantial positive buoyancy when the member is fully inflated. The means for adjusting the strap members is comprised of a buckle member disposed on each of the strap members. The second end of the strap member is passed through a buckle member in a first predetermined direction and is doubled back and passed through the buckle member in a second predetermined direction opposite from the first predetermined direction to form a loop portion. A plastic tie member is preferably inserted through the opening in the nipple member and is wrapped around the loop portion and the respective opposite ends of the tie member are secured together for attaching the cup-shaped suction member to the corresponding strap member. The second attachment surface of the first attachment member has a plurality of hooks projecting therefrom and the fourth attachment surface of the second attachment member has a plurality of loops projecting therefrom for engaging the hooks to provide a secure bond between the first and second attachment members, so that the first end of each strap member is securely fastened to the lower major surface of the inflatable member. The two strap members are preferably attached at respective predetermined positions adjacent to any two of the four corners of the rectangular inflatable member.

BRIEF DESCRIPTION OF THE DRAWINGS

Other aspects and features of the invention will be apparent from the detailed description and claims when read in conjunction with the accompanying drawings wherein:

FIG. 4 is a detail view of a portion of the anchoring apparatus according to the present invention, which is attached to a stationary object, such as the side of a swimming pool or the like.

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
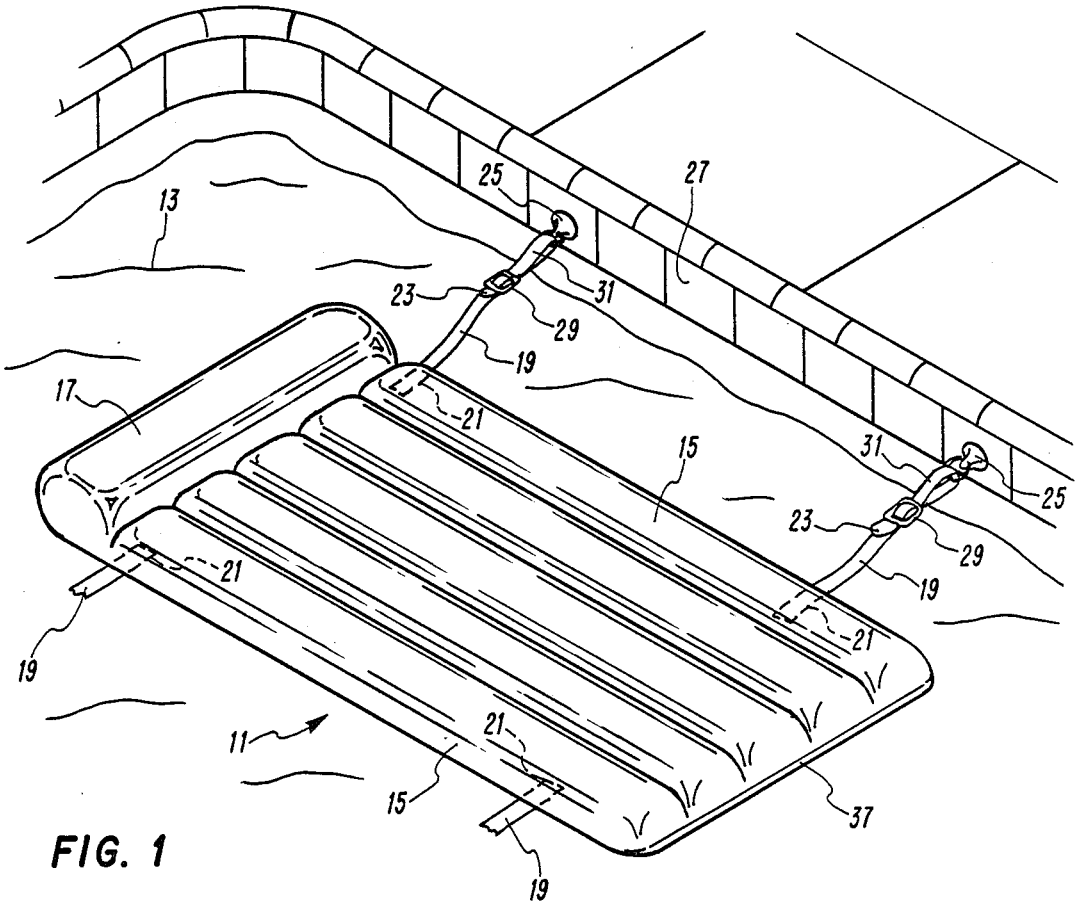
FIG. 1 is a perspective view of a flotation device according to the present invention, which is anchored in a first predetermined position relative to the side of a swimming pool.
Figure 2:
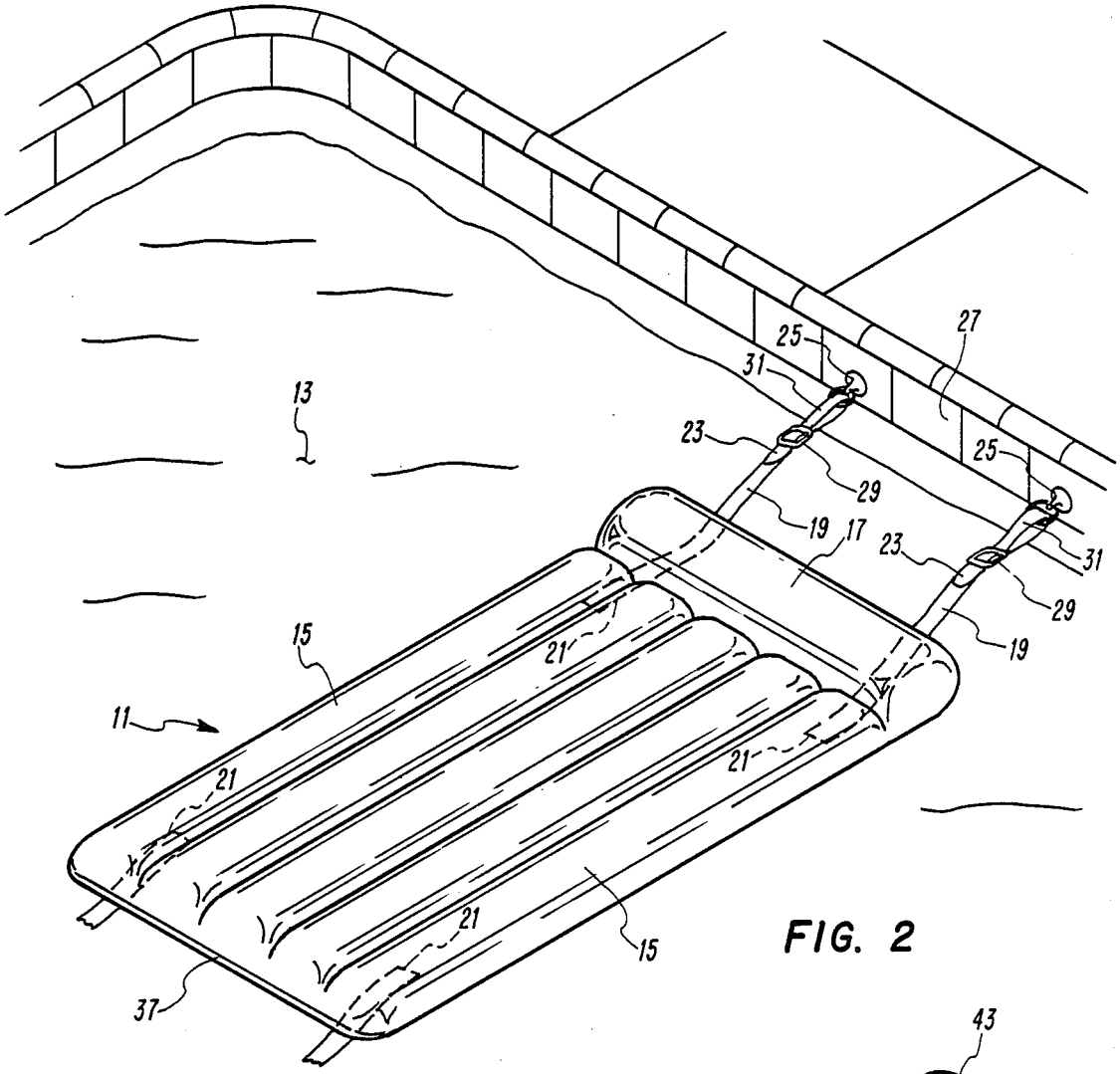
FIG. 2 is a perspective view of the flotation device according to the present invention, anchored in a second predetermined position with respect to the side of a swimming pool.

Referring to FIGS. 1 and 2, a flotation device, such as an inflatable air mattress 11, is shown floating in the water 13 of a swimming pool. Mattress 11 is a relatively flat, rectangular-shaped member having upper and lower major surfaces. Mattress 11 may be comprised of a plastic, vinyl or synthetic material having a plurality of individual airtight compartments 15, which are inflatable to provide the necessary buoyancy for mattress 11 to support the weight of an adult who is reclining on top of mattress 11. In the illustrated embodiment, one end 17 is inflated slightly greater than the remainder of mattress 11 to provide an elevated area for the user's head when he is reclining on the upper major surface of mattress 11. Other flotation devices used in pools and the like include flotation chairs, which may have flotation members constructed of expanded polystyrene or other lighter-than-water materials.

Depending upon the position (in both azimuth and elevation) of the sun, the user may desire to anchor mattress 11 in a predetermined fixed position to take maximum advantage of the direct sunlight. An anchoring apparatus is provided according to the present invention, which is preferably comprised of two adjustable straps 19, each of which is secured at respective first ends 21 thereof to the lower major surface of mattress 11. Adjacent to a second end 23 of each strap 19, opposite from first end 21 thereof, is a plastic suction cup 25, which is secured to the side 27 of the swimming pool to anchor mattress 11 with respect to side 27.

Straps 19 are each preferably comprised of a relatively flat, nylon material. Other shapes and types of material may also be used to form straps 19. Each strap 19 further includes a buckle 29, which is preferably comprised of a lightweight plastic material. Second end 23 of each strap 19 is passed through buckle 29 in a first direction away from mattress 11 and then doubled back and passed through buckle 29 again in a second direction back toward mattress 11 to form a loop portion 31. The effective length of each strap 19 is adjustable by sliding buckle 29 along the length of the corresponding strap 19 to achieve the desired distance between air mattress 11 and side 27 of the swimming pool.

The relative position and orientation of mattress 11 with respect to side 27 and the distance therefrom is determined by attaching selected ones of straps 19 to side 27 and by adjusting the respective lengths of individual straps 19, so that the desired position of mattress 11 relative to the sun's rays can be obtained. Furthermore, suction cups 25 and straps 19 cooperate to securely anchor mattress 11 to prevent it from drifting from the predetermined desired position thereof. For example, as viewed in FIG. 1, the two straps 19 at the head and foot of mattress 11, respectively, on the left side of mattress 11 are anchored to side 27 so that mattress 11 is oriented substantially parallel to side 27 on which straps 19 are anchored. In FIG. 2, the two straps at the head of mattress 11, on either side thereof, are anchored to side 27 so that mattress 11 is oriented substantially perpendicular to side 27 on which straps 19 are anchored. Selected combinations of two or more straps 19 can be anchored at various positions on side 27 of the swimming pool to achieve the desired position and orientation of air mattress 11.

Figure 3:
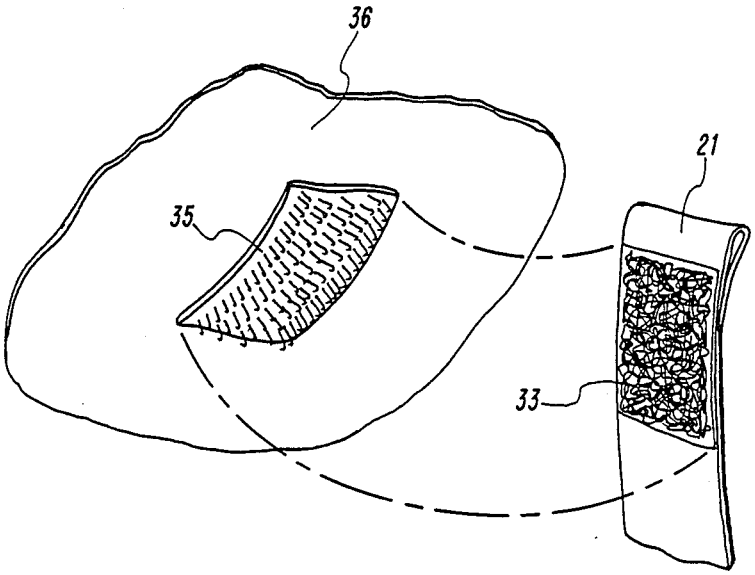
FIG. 3 is a detail view of the attachment of the anchoring apparatus according to the present invention to a flotation device.

Referring to FIG. 3, a first rectangular piece of fabric tape 33 is permanently secured to first end 21 of each strap 19, preferably by sewing. Fabric tape 33 has a pile fabric face on an exposed major surface to provide a plurality of loop elements. A second rectangular piece of fabric tape 35 has a plurality of hook-like elements of a flexible resilient monofilament material formed on a first major surface thereof. A second major surface (not shown) of second fabric tape 35 opposite from the first major surface thereof has an adhesive material disposed thereon for securing second fabric tape 35 to lower major surface 36 of air mattress 11, which is in contact with water 13, at a predetermined fixed position thereon.

Pressing first and second fabric tapes 33 and 35 together produces an intermeshing or locking of the hooks with the pile loops to provide a bond of surprising strength and shear. Peeling the components apart readily separates the bond. First and second fabric tapes 33 and 35 are sold by Velcro Corporation of New York, New York under the trademark "Velcro". Second fabric tape 35 is preferably comprised of industrial strength "Velcro" material to further enhance the bonding between first and second fabric tapes 33 and 35 and counteract the diminution of the adhesive quality of first fabric tape 33 caused by the frequent exposure to water.

Second fabric tape 35 is purchased from the manufacturer with a waterproof backing covering the adhesive surface. When the user desires to attach straps 19 to air mattress 11, he peels off the protective backing to expose the adhesive surface and presses the adhesive surface in contact with lower major surface 36 of mattress 11 at the predetermined desired position. The corresponding strap 19 can then be attached to mattress 11 by positioning first fabric tape 33 substantially in registration with second fabric tape 35 and pressing the two fabric tapes together to form a secure bond. Although the user is able to position fabric tape 35 at any desired location on mattress 11, the preferred locations thereof are slightly aft of headrest 17 on either side of mattress 11 for the first two positioning and somewhat forward of the foot end 37 of mattress 11, as best shown in FIGS. 1 and 2. Fabric tapes 35 are preferably secured to mattress 11 in a substantially symmetrical manner, as shown, adjacent to the respective four corners of mattress 11, to balance the torque or twisting effect on mattress 11 so that the net rotation of mattress 11 caused by a force acting in or parallel to lower major surface 36 is effectively zero. First and second fabric tapes 33 and 35 may be interchanged so that the hook elements are disposed on straps 19 and the pile elements are disposed on lower major surface 36 of mattress 11 as a matter of design choice.

Figure 4:
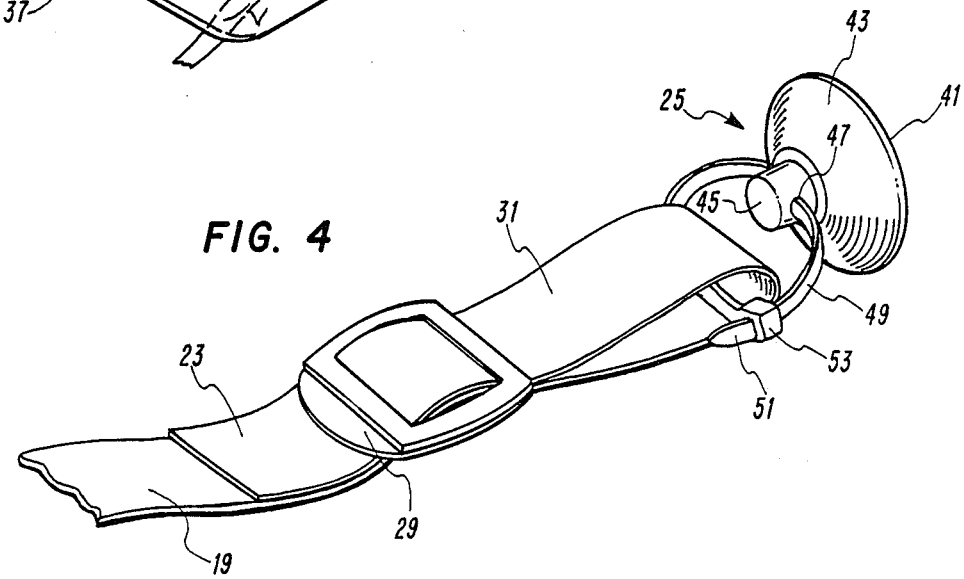

Referring to FIG. 4, suction device 25 is preferably comprised of a cup-shaped member 41 having a concave inner surface (not shown) and a convex outer surface 43. A cylindrical nipple 45 is disposed in the approximate geometric center of cup-shaped member 41. Nipple 45 has an opening 47 extending radially therethrough for receiving a plastic tie member 49. A male end 51 of tie member 49 is inserted through opening, is wrapped around loop portion 31 of corresponding strap 19 and mates with a complementary opening in female end 53 of tie member 49 to securely attach suction device 25 to strap 19.

Cup-shaped member 41 is preferably comprised of a conically-shaped, transparent plastic material so as not to be readily noticeable when attached to side 27 of a swimming pool. Cup-shaped member 41 preferably has a diameter on the order of 1¾ inches across the widest portion thereof. The suction attachment is achieved when cup-shaped member 41 is placed in contact with a relatively flat surface, such as side 27, and slight pressure is exerted on convex outer surface 43 so that air is expelled from the region between the concave inner surface and side 27, thereby creating a vacuum in the region. Thus, atmospheric pressure holds suction device 25 securely in position against side 27. Suction device 25 provides sufficient suction power to securely fasten straps 19 to side 27, to prevent air mattress 11 from becoming disengaged from side 27 under normal conditions. On the other hand, it is not desirable for the suction force to be so great that it is difficult to dislodge suction device 25 when desired.

Furthermore, suction device 25 and/or fabric tape 33 attached to strap 19, disengage in the event that substantial force is exerted normal to the axis of straps 19, such as when an individual jumps or falls on straps 19 while straps 19 are attached to side 27. The force exerted by the weight of an individual jumping or falling on straps 19 will quickly dislodge suction devices and/or fabric tapes 33 attached to strap 19, so as not to cause injury to the individual. The anchoring apparatus according to the present invention is however not designed for or intended to be used as a safety or security type device.

The anchoring apparatus according to the present invention has been found to provide an economical and easy-to-use apparatus for securing a flotation device, such as an inflatable air mattress, to a stationary object, such as the side of a swimming pool. Suction devices 25 used to attach the flotation device are suitable for attachment to various types of stationary objects and materials, including, but not limited to, ceramic and marble pool tile, wooden decking and aluminum ladders. Furthermore, by using the "Velcro" attachment members, straps 19 can be securely attached to a variety of types of flotation devices and materials, including, but not limited to, vinyl, canvas, plastic, styrofoam, wood, aluminum and foam rubber.

By attaching selected ones of straps 19 to a stationary object and adjusting the respective lengths of the selected straps, the flotation device can be maintained in a desired fixed position and orientation with respect to the stationary object. The anchoring apparatus according to the present invention is particularly suitable for use by sunbathers because the flotation device can be adjusted as desired to take advantage of the location of the sun at any given time.

Various embodiments of the invention have been described in detail. Since changes in and modifications to the above-described preferred embodiment may be made without departing from the nature, spirit and scope of the invention, the invention is not to be limited to said details, except as set forth in the appended claims.

We claim:

1. An apparatus for anchoring a flotation device to a stationary object when the device is floating in a body of water, said flotation device having sufficient buoyancy and surface area above the water line for supporting the weight of a user so that the user's body is maintained substantially completely above the water line, said apparatus comprising:

a plurality of strap members;

means for selectively adjusting the respective lengths of said strap members;

means for attaching respective first ends of said strap members to said flotation device at respective predetermined positions on a surface thereof; and suction means coupled to each of said strap members adjacent to a second end of each of said strap members opposite from said first end for attaching the respective strap members to a relatively flat vertical wall on said stationary object above the water line to anchor the flotation device to the stationary object, the position and orientation of said flotation device relative to the stationary object being selectively determined by the predetermined positions on the flotation device at which said strap members are attached and by the adjustment of the respective lengths of the selected strap members.

2. The apparatus according to claim 1 wherein said suction means coupled to each of said strap members provides a suction force which is sufficient to maintain the attachment of said strap members to said relatively flat vertical wall, despite the application of a force acting in a direction substantially parallel with respect to the surface of the body of water and yet will readily become detached from said relatively flat vertical wall when a substantial force is applied to a corresponding strap member acting in a direction normal to the surface of the body of water.

3. The apparatus according to claim 1 wherein said flotation device has a rectangular shape, said plurality of straps being attached at respective predetermined positions adjacent to selected corners of said device.

4. The apparatus according to claim 1 wherein said means for adjusting said strap is comprised of a buckle member positioned on each of said straps, said second end of each strap being passed through said buckle member in a first direction and being doubled back and passed through said buckle member in a second direction opposite from said first direction to form a loop portion.

5. The apparatus according to claim 4 wherein said means for anchoring said flotation device includes a tie member for coupling said anchoring means to said loop portion.

6. The apparatus according to claim 1 wherein said anchoring means is comprised of a suction device having a cup-shaped member for providing a suction attachment to said stationary object.

7. The apparatus according to claim 6 wherein said anchoring means includes a nipple member joined to said cup-shaped member and having an opening extending radially therethrough, said anchoring means further including a tie member, one end of which is inserted through the opening, wrapped around the strap and secured to the opposite end of said tie member to secure the suction device to the strap.

8. The apparatus according to claim 1 wherein said means for attaching said straps to said flotation device is comprised of a first attachment member having a first attachment surface for being attached to a lower major surface of the flotation device and a second attachment surface opposite from said first attachment surface, and a second attachment member having a third attachment surface which is in contact with the corresponding strap and a fourth attachment surface opposite from said third attachment surface which is complementary with said second attachment surface, said strap being attached to the flotation device when said second and fourth attachment surfaces are pressed into contact.

9. The apparatus according to claim 8 wherein the second attachment surface of said first attachment member has a plurality of hooks disposed thereon and said fourth attachment surface of said second attachment member has a plurality of loops disposed thereon for engaging said hooks to form a secure bond between said first and second attachment members.

10. A flotation device, comprising:

a relatively flat member having sufficient buoyancy and surface area above the water line to support the weight of the user so that the user's entire body is maintained substantially completely above the water line;

a plurality of strap members attached at respective predetermined positions on a lower major surface of said relatively flat member for being positioned in contact with the water, said predetermined positions being substantially symmetrically disposed with respect to the geometry of said relatively flat member;

means for adjusting the respective lengths of said strap members;

means for attaching the first end of each of said strap members to the relatively flat member at the respective predetermined positions on said lower major surface thereof; and suction means coupled to each of said strap members adjacent to a second end thereof opposite from said first end for attaching the strap members to a relatively flat vertical wall surface above the water line on a stationary object, thereby anchoring the relatively flat member to the stationary object, the position and orientation of the relatively flat member with respect to said stationary object being determined by the predetermined positions on said relatively flat member at which said strap members are attached and by the adjustment of the respective lengths of said selected ones of such strap members.

11. The flotation device according to claim 10 wherein said suction means for anchoring said relatively flat member is comprised of a suction device having a cup-shaped member and a cylindrical nipple member disposed in the approximate geometric center of said cup-shaped member, said cup-shaped member for engaging said relatively flat surface of said stationary object to provide a suction attachment thereto and said nipple member having an opening extending radially therethrough for receiving a tie member or the like to secure said suction device to said strap member.

12. The flotation device according to claim 11 wherein said relatively flat member is comprised of an inflatable member and has a substantially rectangular shape, said strap member being attached thereto at respective predetermined positions adjacent to the respective corners of said inflatable member.

13. The flotation device according to claim 12 wherein said means for adjusting said strap members is comprised of a buckle member disposed on each of said strap members, said second end of each strap member being passed through said buckle member in a first predetermined direction and being doubled back and passed through said buckle member in a second predetermined direction opposite from said first direction to form a loop portion, said device further including a tie member, one end of which is inserted through said opening in said nipple member, wrapped around said loop portion and secured to a complementary second end of said tie member, to provide a secure attachment between said cup-shaped member and the corresponding strap member.

14. The device according to claim 13 wherein said means for attaching said strap members to said flotation device is comprised of a first attachment member having a first attachment surface secured to the lower major surface of said inflatable member and a second attachment surface opposite from said first attachment surface, and a second attachment member having a third attachment surface secured to the first end of the corresponding strap member and a fourth attachment surface opposite from said third attachment surface which is complementary with said second attachment surface, said strap member being attached to said inflatable member when said second and fourth attachment surfaces are pressed into contact.

15. A method for positioning a flotation device in a body of water for sunbathing, said flotation device having sufficient buoyancy and surface area above the water line to support the weight of the user so that the user's entire body is maintained substantially completely above the water line, said method comprising the steps of:

providing a plurality of strap members;

attaching respective first ends of said plurality of strap members to respective selected positions on said flotation device; and attaching respective second ends of said plurality of strap members, oppsite from said respective first ends, to a relatively flat vertical wall of a stationary object above the water line, to secure the flotation device in a predetermined position with respect to the sun.

16. The method according to claim 15 wherein said flotation device has a substantially rectangular shape with respective first and second opposite major axes extending along respective opposite first and second sides of said device and respective first and second opposite minor axes extending along opposite first and second ends of said device and said method includes the steps of attaching respective first ends of first and second straps to respective first and second corners of said device at respective first and second opposite ends of said device on the first side thereof, and attaching respective second ends of said first and second straps to said vertical wall so that said first and second major axes of said device are oriented substantially parallel with respect to said vertical wall and the first and second opposite ends of said device are attached to said vertical wall, thereby substantially preventing said device from twisting with respect to the vertical wall.

17. The method according to claim 15, further including the step of periodically adjusting the attachment positions of the respective first ends of said strap members on said flotation device to change the position of said flotation device with respect to the stationary object as required to maintain a desired orientation of the flotation device relative to the position of the sun.

18. The method according to claim 17 further including the step of selectively adjusting the respective lengths of the strap members to maintain a desired orientation of the flotation device relative to the position of the sun.

19. The method according to claim 15 wherein said flotation device is anchored so that it is substantially prevented from twisting with respect to the stationary object.

20. The method according to claim 15 wherein said respective first ends of said strap members are attached to a lower major surface of said flotation device which is in contact with the fluid in which the device is floating so as not to cause irritation to a user who is reclining on an upper major surface of the flotation device opposite from said lower major surface.

* * * * *